US005686950A

United States Patent [19]

Hirakue

[11] Patent Number: 5,686,950

[45] Date of Patent: Nov. 11, 1997

[54] MOUNTING DEVICE AND A RECORDING APPARATUS INCLUDING THE SAME

[75] Inventor: Toshimitsu Hirakue, Tokyo, Japan

[73] Assignee: Canon Kabushiki Kaisha, Tokyo, Japan

[21] Appl. No.: 432,724

[22] Filed: May 2, 1995

[30] Foreign Application Priority Data

May 9, 1994 [JP] Japan ..... 6-094780

[51] Int. Cl.[6] ..... B41J 2/01; B65H 31/00; B65H 31/26

[52] U.S. Cl. ..... 347/104; 271/209; 271/220

[58] Field of Search ..... 347/104; 271/209, 271/220

[56] References Cited

U.S. PATENT DOCUMENTS

| | | | |
|---|---|---|---|
| 4,353,542 | 10/1982 | Knight et al. | 271/209 |
| 4,400,124 | 8/1983 | Greller | 571/209 |
| 4,469,319 | 9/1984 | Robb et al. | 271/3.04 |
| 4,898,374 | 2/1990 | Vermaat | 571/209 |
| 4,934,687 | 6/1990 | Hayden et al. | 271/202 |
| 5,358,231 | 10/1994 | Andela | 271/188 |
| 5,419,548 | 5/1995 | Ueda et al. | 571/209 |
| 5,451,044 | 9/1995 | Nakayama | 271/209 |

*Primary Examiner*—Valerie Lund

*Attorney, Agent, or Firm*—Fitzpatrick, Cella, Harper & Scinto

[57] ABSTRACT

A recording apparatus includes a mounting unit for mounting a discharged sheet material, elastic guide members capable of being curved/restored in order to receive end portions of the sheet material in the direction of the width being discharged onto the mounting unit, and pressing members for providing/releasing a pressing force for the elastic guide members. The sheet material being discharged onto the mounting unit is held by curved portions of the elastic guide members when the elastic guide members are curved, and the holding of the sheet material is released when the elastic guide members return to their restored state so that the sheet material drops into the mounting unit.

20 Claims, 5 Drawing Sheets

MOUNTING DEVICE AND A RECORDING APPARATUS INCLUDING THE SAME

BACKGROUND OF THE INVENTION

1. Field of the Invention

This invention relates to a discharging/mounting device and a recording apparatus including the device. More particularly, the invention relates, for example, to a recording apparatus including a mounting unit for mounting a recording medium discharged after recording has been performed thereon by a recording unit.

2. Description of the Related Art

Various kinds of recording apparatuses for performing predetermined recording on a recording medium are in practical use. In particular, various kinds of ink-jet recording apparatuses for performing recording by discharging ink in accordance with a signal have been developed. In the ink-jet recording apparatus, recording is performed by directly discharging ink from an ink-discharging surface of a recording head onto a recording medium conveyed by a recording-medium conveying mechanism, and the recording material on which the recording has been performed is discharged onto a discharging tray or the like outside of the apparatus.

In the ink-jet recording apparatus, recording is performed by discharging ink directly onto a recording medium. Hence, if a recording medium is discharged onto another recording medium immediately after the first recording medium has been discharged, problems caused by insufficiently dried ink on the first discharged recording medium, such as contamination and disturbance in the recorded image, arise.

SUMMARY OF THE INVENTION

The present invention has been made in consideration of the above-described problems.

It is an object of the present invention to provide an inexpensive sheet discharging/mounting device having a simple configuration in which contamination or disturbance of a recorded image on a discharged recording medium is prevented, and to provide a recording apparatus including such a device.

According to one aspect, the present invention, which achieves the above-described objects, relates to a discharging/mounting device comprising mounting means for mounting a discharged sheet material, elastic guide means capable of being curved/restored in order to receive edges of the sheet material being discharged onto the mounting means, and pressing means for providing/releasing a pressing force for the elastic guide means. The sheet material being discharged onto the mounting means is held by curved portions of the elastic guide means when the elastic guide means are curved, and the holding of the sheet material is released when the elastic guide means return to their original state.

In this configuration, since the sheet material being discharged is mounted onto the mounting means by holding the sheet material by the curved portions of the elastic guide means when the elastic guide means are curved, and releasing the holding of the sheet material when the elastic guide means return to their initial state, the discharged sheet material does not rub the surface of the previously discharged sheet material mounted on the mounting means. Accordingly, contamination and disturbance in the recorded image on the recording medium can be prevented with a simple configuration.

According to another aspect, the present invention relates to a recording apparatus comprising recording means for performing predetermined recording on a recording medium, conveying means for conveying the recording medium relative to the recording means and for discharging the recording medium on which the recording has been performed, mounting means for mounting the discharged recording medium, elastic guide means capable of being curved/restored in order to receive side edges of the recording medium being discharged on the mounting means, and pressing means for providing/releasing a pressing force for the elastic guide means. The sheet material being discharged onto the mounting means is held by curved portions of the elastic guide means when the elastic guide means are curved, and the holding of the sheet material is released when the elastic guide means return to their initial state.

By further providing an auxiliary guide plate for guiding and supporting the recording medium being discharged at the elastic guide means, the recording medium can be guided and supported in a more stable state in addition to the above-described effect.

By configuring the elastic guide means and the pressing means so as to be slidable in the direction of the width of the recording medium, it is possible to adjust a position to receive a recording medium being discharged in accordance with the size of the recording medium in the direction of the width, and therefore to deal with various kinds of recording mediums, in addition to the above-described effect.

By adopting an ink-jet method for the recording means, it is possible to perform high-speed recording with low noise, and to perform recording having high picture quality.

The foregoing and other objects, advantages and features of the present invention will become more apparent from the following description of the preferred embodiments taken in conjunction with the accompanying drawings.

DESCRIPTION OF THE PREFERRED EMBODIMENTS

First Embodiment

Figure 1:
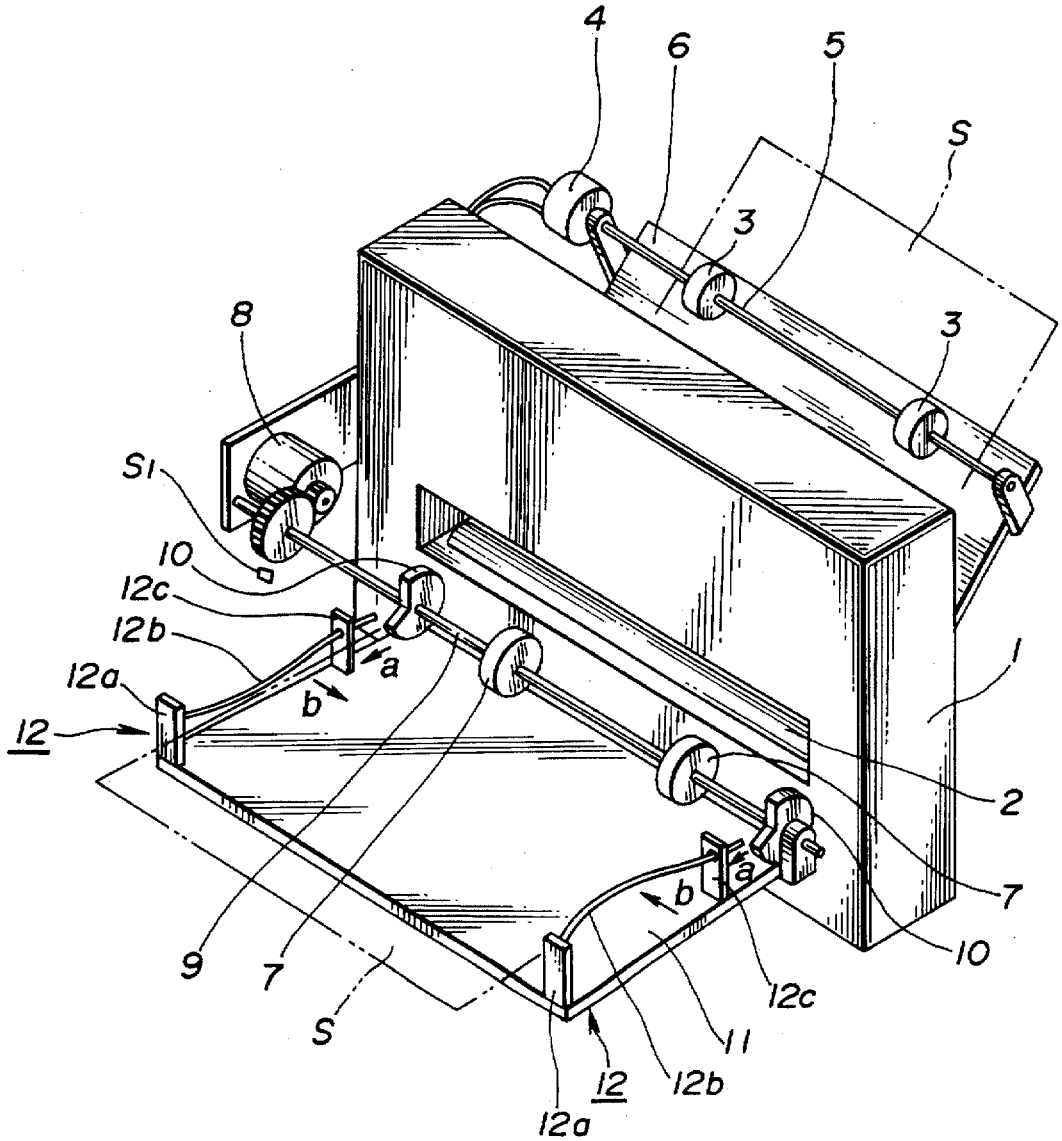
FIG. 1 is a perspective view illustrating an external appearance of a recording apparatus according to a first embodiment of the present invention.
Figure 2:
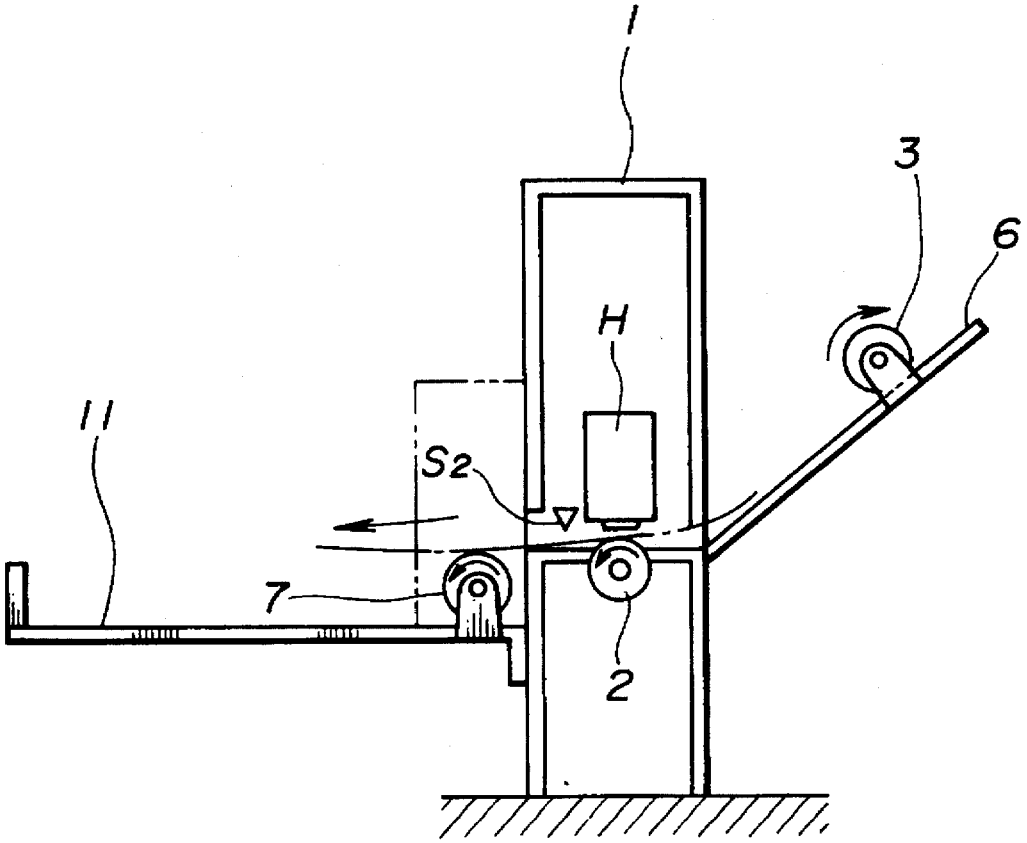
FIG. 2 is a cross-sectional view of the recording apparatus shown in FIG. 1.

A description will now be provided of a recording apparatus according to a first embodiment of the present invention with reference to the drawings. FIG. 1 is a perspective view illustrating an external appearance of the recording apparatus. FIG. 2 is a schematic cross-sectional view of the recording apparatus.

In FIGS. 1 and 2, a main body 1 of the apparatus includes a recording head H for recording an ink image on a recording sheet S, serving as a recording medium, and a platen roller 2 for conveying the recording sheet S while supporting the back of the recording sheet S at a recording position. An ink-jet recording method in which recording is performed by discharging ink from a recording head is adopted in this apparatus. That is, the recording head H includes fine liquid discharging ports (orifices), a liquid channel, an energy-operating unit provided at a portion of the liquid channel, an energy-generating device for generating liquid-drop-forming energy for operating on a liquid at the energy-operating unit, and the like.

Any one of a number of recording methods may be used. For example, there is a recording method using electromechanical transducers, such as piezoelectric elements or the like, a recording method using the energy-generating device in which the liquid is heated by projecting an electromagnetic wave, such as a laser beam or the like, thereon and liquid droplets are discharged by the heating, and a recording method in which the liquid is discharged by being heated by electrothermal transducers, such as heating elements comprising heating resistors, or the like.

Feeding rollers 3 are mounted on a driving shaft 5 rotatably driven by a feeding motor 4 so as to individually separate and feed recording sheets S mounted on a feeding stacker 6.

Discharging rollers 7 are mounted on a driving shaft 9 rotatably driven by a driving force transmitted from a discharging motor 8 so as to convey and discharge the recording sheet S on which recording has been performed. Cam members 10 (each having a notch at a portion thereof), serve as pressing means for providing/releasing a pressing force for elastic guide units disposed at predetermined positions of mounting means (to be described later). Cam members 10 are disposed on the driving shaft 9, on which the discharging rollers 7 are mounted, at positions outside an area of the maximum width of recording sheets to be used. The cam surface of each of the cam members 10 is formed so that its diameter gradually increases in the direction of rotation in a counterclockwise direction in FIG. 1. The state shown in FIG. 1 (i.e., the state in which each of the notches faces a distal end of the corresponding elastic member) is a home position. This position is detected by a sensor $S_1$.

A discharging tray 11, serving as the mounting means, mounts the recording sheet S discharged after recording. Elastic guide units 12 disposed on the discharging tray 11 are provided for receiving two end portions of the recording sheet S in the direction of the width are disposed outside the maximum width of recording sheets to be used. Each of the elastic guide units 12 comprises a support **12*a* fixed and supported on the discharging tray 11, an elastic member 12*b*, capable of being curved/restored, and whose one end is supported on the support 12*a*, and a guide post 12*c* which slidably supports another end of the elastic member 12*b*. The elastic member 12*b* is usually more or less curved toward the inside of the discharging tray 11. In the present embodiment, a SUS (stainless-steel) wire is used as the elastic member 12*b*. However, the material for the elastic member 12*b*** is not limited to this material. Any appropriate material, such as an elastic steel sheet, a synthetic resin such as polycarbonate, POM or the like, may be also used.

According to the above-described configuration, when the recording sheet S (detected by a sensor $S_2$) on which predetermined recording has been performed starts to be discharged, the cam members 10 rotate together with the discharging rollers 7 and the other end of each of the elastic members **12*b* contacts the cam surface of the outer circumference of the corresponding cam member 10, whereby each of the elastic members 12*b* is deformed by a pressing force toward the axial direction (the direction of an arrow "a" shown in FIG. 1) to be further curved (protruded) toward the inside of the discharging tray 11 (the direction of an arrow "b" shown in FIG. 1). The curved portions of the elastic members 12*b* guide and support the recording sheet S being discharged. When the recording sheet S has been completely discharged (when the cam members 10 have performed one revolution), the pressing force by the cam members 10 is released, and each of the elastic members 12*b* returns to the initial state by its restoring force. As a result, the holding of the recording sheet S supported by the curved portions of the elastic members 12*b* is released, and the recording sheet S drops onto the discharging tray 11**.

When performing consecutive recordings, the above-described operation is repeated.

Accordingly, the discharged recording sheet does not rub the recording surface of another recording sheet mounted on the discharging tray. Hence, even if consecutive recording is performed, contamination and disturbance in the image of the recording sheet can be prevented.

Second Embodiment

Figure 3:
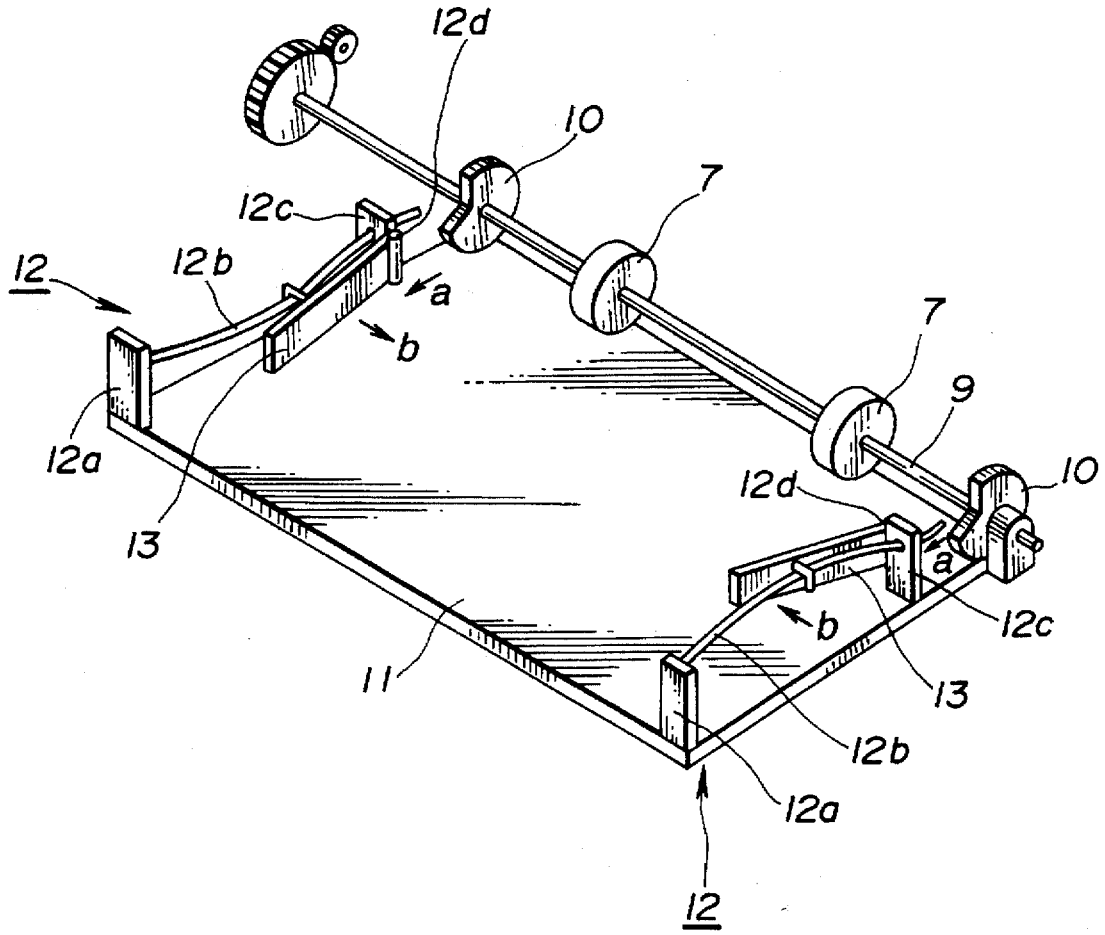
FIG. 3 is a schematic diagram illustrating a principal portion of a recording apparatus according to a second embodiment of the present invention.
Figure 4:
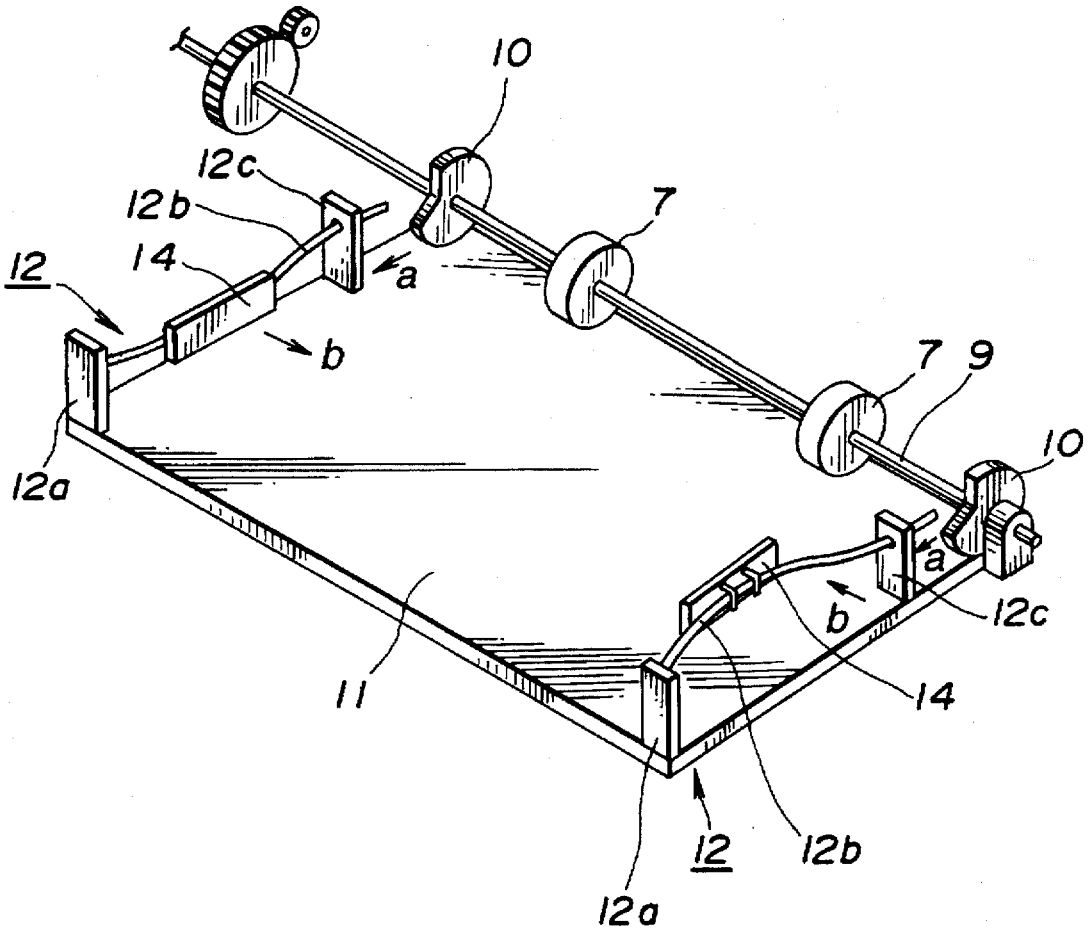
FIG. 4 is a schematic diagram illustrating a principal portion of a recording apparatus according to a modification of the second embodiment.

Next, a description will be provided of a recording apparatus according to a second embodiment of the present invention with reference to FIGS. 3 and 4. Since the schematic configuration of the entire apparatus of the present embodiment is substantially the same as that of the first embodiment, a description of the schematic configuration of the entire apparatus for the second embodiment will be omitted, and only characteristic portions having a different configuration will be described. FIGS. 3 and 4 are schematic diagrams illustrating a principal portion of the recording apparatus of the present embodiment.

In the above-described first embodiment, the curved portion of each of the elastic members **12*b* of the elastic guide units 12** supports the recording sheet S being discharged. However, the present invention is not limited to such an approach, but a configuration in which each of the elastic guide members further includes an auxiliary guide member for guiding and supporting the recording sheet being discharged is also included.

For example, as shown in FIG. 3, a rotating plate 13, serving as the auxiliary guide member, may be mounted on each of the elastic members **12*b* so that one end of the rotating plate 13 is supported on the corresponding guide post 12*c* so as to be rotatable around a shaft 12*d*. Each of the rotating plates 13 rotates about shaft 12*d* toward the inside of the discharging tray 11 together with the corresponding elastic member 12*b* curved by the pressing force, and returns to its initial position together with the elastic member 12*b*** restored to the initial state by releasing the pressing force.

In another approach, as shown in FIG. 4, a moving plate 14, serving as the auxiliary guide member, may be mounted at a central portion of each of the elastic members **12*b*. Each of the moving plates 14 moves toward the inside of the discharging tray 11 together with the corresponding elastic member 12*b* curved by the pressing force, and returns to its initial position together with the elastic member 12*b*** restored to the initial state by releasing the pressing force.

According to the above-described configuration, the same effects as in the first embodiment may be obtained, and the recording sheet can be guided and supported in a more stable state.

Third Embodiment

Figure 5:
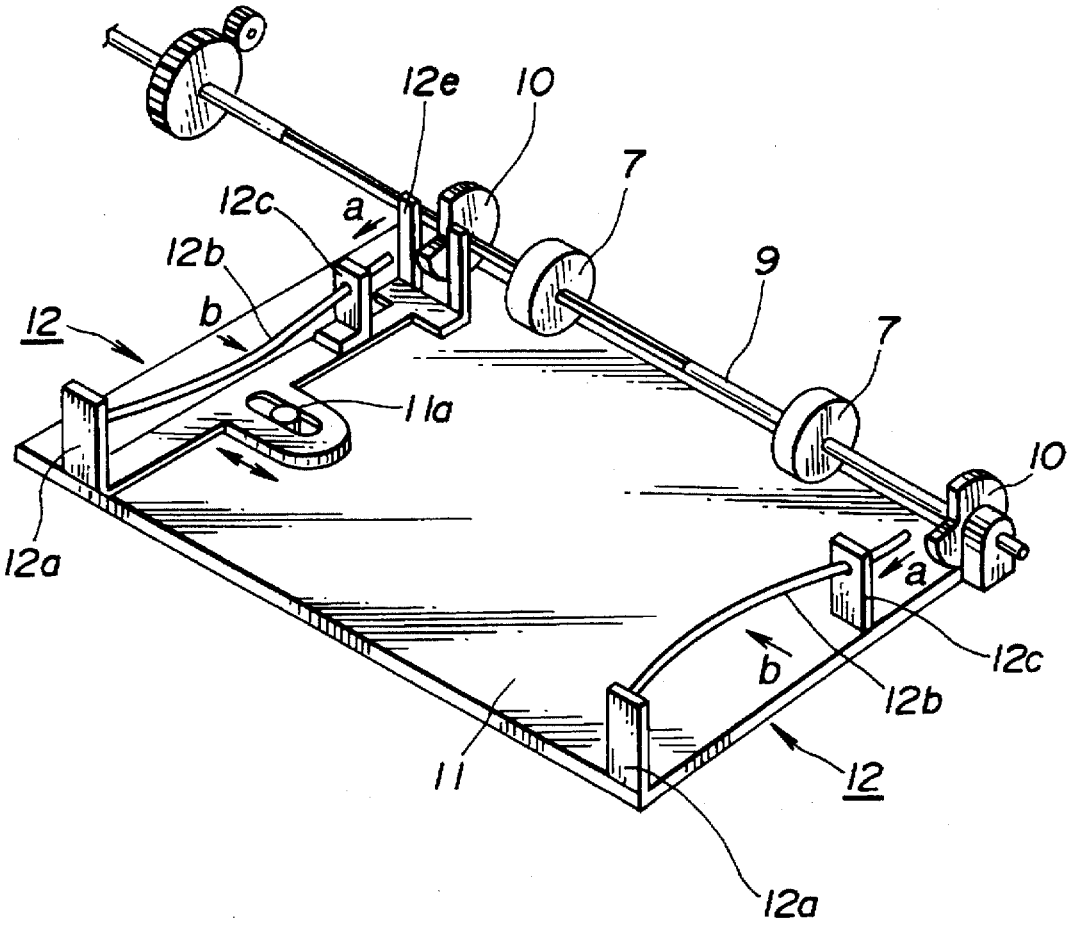
FIG. 5 is a schematic diagram illustrating a principal portion of a recording apparatus according to a third embodiment of the present invention.

Next, a description will be provided of a recording apparatus according to a third embodiment of the present invention with reference to the drawings. Since the schematic configuration of the entire apparatus of the present embodiment is substantially the same as that of the first embodiment, a description of the schematic configuration of the entire apparatus for the third embodiment will be omitted, and only characteristic portions having a different configuration will be described. FIG. 5 is a schematic diagram illustrating a principal portion of the recording apparatus of the third embodiment.

In the third embodiment, as shown in FIG. 5, the elastic guide units 12 and the cam members 10, serving as the pressing means, having the above-described configuration are slidable in the direction of the width of the sheet. The cam members 10 are supported on the shaft 9 so as to be slidable in the same direction and rotatable as one body with the shaft 9. One of the elastic guide units 12 is slidably supported on the tray 11 by pin 11*a*, and includes a U-shaped vertical portion 12*e*. The vertical portion 12*e* is U-shaped so that the corresponding cam member 10 can rotatably enter therein. Accordingly, if the cam member 10 slides, the force of the cam member 10 is transmitted to the guide unit 12. Although omitted in FIG. 5, a plurality of pins 11*a* are provided, so that the guide units 12 can slide without being inclined. According to this configuration, the same effects as in the above-described embodiments may be obtained, and it is also possible to adjust a position to receive a discharged sheet in accordance with the size of the recording sheet in the direction of the width, and therefore to deal with various kinds of recording sheets.

Although in FIG. 5, only one (at the left) of the elastic guide units 12 and its corresponding cam member 10 are made to be slidable, the present embodiment is not limited to such a configuration. For example, both combinations of the elastic guide units 12 and the cam members 10 may be slidable in the direction of the width of the sheet.

Other Embodiments

Although each of the above-described embodiments of the present invention is applied to a recording apparatus including a serial recording head, as shown in FIG. 2, the present invention is not limited to such a recording apparatus. For example, the present invention may be effectively applied to a recording apparatus including a full-line recording head having a length corresponding to the maximum width of recording media which can be recorded by the recording apparatus. Such a recording head may consist of a combination of a plurality of recording heads covering the entire recording length, or by a single recording head formed as one body.

Furthermore, the above-described serial recording head may comprise a recording head fixed to a carriage, an interchangeable chip-type recording head which can be electrically connected to the main body of the apparatus or to which ink can be supplied from the main body of the apparatus by being mounted on a carriage, or a catridge-type recording head including an ink tank as one body therewith.

Various combinations may be adopted for the kinds and the number of recording heads mounted on a carriage. For example, a single recording head may be provided corresponding to ink having a certain color, or a plurality of recording heads may be provided corresponding to various kinds of ink having different colors and densities. That is, the present invention may be applied not only to a recording apparatus having a recording mode in a principal color, such as black or the like, but also to a recording apparatus having a recording mode in at least one of a plurality of colors and a full color obtained by mixing colors, and having either a recording head configured as one body or a combination of a plurality of recording heads.

The above-described recording apparatus may be used not only as an image output terminal of an information processing apparatus, such as a computer or the like, but also as a copier combined with a reader or a facsimile apparatus having a transmission/reception function.

Although in the above-described embodiments the ink-jet recording method has been illustrated, the present invention is not limited to the ink-jet recording method, but the present invention may be applied to any other method, such as a thermal transfer recording method, a thermal recording method, a wire-dot recording method or the like.

The cam members 10 and the discharging rollers 7 are not always coaxial, but may be supported by different shafts via a gear train.

A sheet may be discharged by being grasped by the discharging rollers 7 and pinch rollers provided thereabove.

The elastic guide units 12 are not always provided at two sides, but may be provided only at one side.

Although in the above-described embodiments the elastic members 12 are more or less curved while in a waiting state, the present invention is not limited to such a state. For example, the elastic members 12 may be arranged to be straight in a waiting state.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A mounting device comprising:

mounting means for mounting a discharged sheet material;

elastic guide means attached to said mounting means for receiving a side edge of a discharged sheet material, said elastic guide means being deformable between a protruded state and a restored state; and pressing means for providing and releasing a pressing force against said elastic guide means so as to press said elastic guide means to the protruded state and to release said elastic guide means to the restored state, wherein the sheet material being discharged onto said mounting means is held above said mounting means by protruded portions of said elastic guide means when said elastic guide means are in the protruded state, and the holding of the sheet material is released when said elastic guide means is returned to the restored state.

2. A device according to claim 1, wherein said pressing means comprises a cam member rotating in synchronization with the discharge of the sheet.

3. A device according to claim 2, wherein said elastic guide means comprises a wire.

4. A device according to claim 2, wherein said elastic guide means are provided at two end portions in the direction of the width of the sheet material.

5. A device according to claim 1, wherein the restored state is a curved state and the protruded state is a curved state with a greater curve than the restored state.

6. A device according to claim 1, wherein the elastic guide means is extended in the direction of sheet material discharging direction, with one end being fixed and the other end being supported so as to be movable in the discharging direction, and the pressing means acts on said other end.

7. A recording apparatus comprising:

recording means for recording on a recording medium;

conveying means for conveying the recording medium on which recording has been performed from said recording means and for discharging from said apparatus the recording medium;

mounting means for mounting the discharged recording medium;

elastic guide means attached to said mounting means for receiving a side edge of a discharged sheet material, said elastic guide means being deformable between a protruded state and a restored state; and pressing means for providing and releasing a pressing force against said elastic guide means so as to press said elastic guide means to the protruded state and to release said elastic guide means to the restored state, wherein the sheet material being discharged onto said mounting means is held above said mounting means by protruded portions of said elastic guide means when said elastic guide means are in the protruded state, and the holding of the sheet material is released when said elastic guide means is returned to the restored state.

8. An apparatus according to claim 7, wherein said conveying means comprises feeding rotating members and discharging rotating members, and wherein said pressing means comprises a cam member rotating in synchronization with said discharging rotating members.

9. An apparatus according to claim 8, wherein said elastic guide means comprises a wire.

10. An apparatus according to claim 9, wherein said wire mounts an auxiliary guide plate for guiding and supporting the recording medium being discharged.

11. An apparatus according to claim 10, wherein said recording means records by an ink-jet recording method wherein ink is discharged.

12. An apparatus according to claim 9, wherein said recording means records by an ink-jet recording method wherein ink is discharged.

13. An apparatus according to claim 8, wherein said recording means records by an ink-jet recording method wherein ink is discharged.

14. An apparatus according to claim 8, wherein said elastic guide means are provided at two end portions in the direction of the width of the sheet material.

15. An apparatus according to claim 14, wherein said recording means records by an ink-jet recording method wherein ink is discharged.

16. An apparatus according to claim 8, wherein said cam members and said discharging rotating members are coaxial.

17. An apparatus according to claim 16, wherein said recording means records by an ink-jet recording method wherein ink is discharged.

18. An apparatus according to claim 7, wherein said elastic guide means and said pressing means are slidable in the direction of the width of the recording medium.

19. An apparatus according to claim 11, wherein said recording means records by an ink-jet recording method wherein ink is discharged.

20. An apparatus according to claim 7, wherein said recording means records by an ink-jet recording method wherein ink is discharged.

* * * * *